US008632364B2

(12) United States Patent
Lee et al.

(10) Patent No.: US 8,632,364 B2
(45) Date of Patent: Jan. 21, 2014

(54) SOCKET FOR WEDGE BULB

(75) Inventors: Chul Sub Lee, Daegu (KR); Kyung Hee Lim, Daegu (KR)

(73) Assignees: Tyco Electronics Amp Korea Ltd. (KR); SL Corporation (KR)

( * ) Notice: Subject to any disclaimer, the term of this patent is extended or adjusted under 35 U.S.C. 154(b) by 16 days.

(21) Appl. No.: 13/392,287

(22) PCT Filed: Sep. 3, 2010

(86) PCT No.: PCT/KR2010/005989
§ 371 (c)(1),
(2), (4) Date: Feb. 24, 2012

(87) PCT Pub. No.: WO2011/028053
PCT Pub. Date: Mar. 10, 2011

(65) Prior Publication Data

US 2012/0156944 A1 Jun. 21, 2012

(30) Foreign Application Priority Data

Sep. 7, 2009 (KR) ..... 10-2009-0083831

(51) Int. Cl.
*H01R 33/09* (2006.01)

(52) U.S. Cl.
USPC ..... 439/619

(58) Field of Classification Search
USPC ..... 439/619, 699.2, 356, 349; 313/318.01, 313/318.05, 318.09; 362/655
See application file for complete search history.

(56) References Cited

U.S. PATENT DOCUMENTS 4,958,429 A * 9/1990 Forish et al. ..... 29/877
5,008,588 A * 4/1991 Nakahara ..... 313/318.1
5,120,233 A * 6/1992 Mikola ..... 439/356
5,951,318 A * 9/1999 Harada ..... 439/356
6,083,050 A * 7/2000 Hsu ..... 439/619
6,083,054 A * 7/2000 Suzuki et al. ..... 439/699.2
6,411,021 B1 * 6/2002 Izawa et al. ..... 313/315
6,548,949 B2 * 4/2003 Ishihara ..... 313/318.09
6,616,474 B2 * 9/2003 Aiso ..... 439/356
6,815,878 B2 * 11/2004 Bryant ..... 313/318.01
6,992,429 B2 * 1/2006 Ishihara ..... 313/318.05
7,021,815 B1 * 4/2006 Yang ..... 362/655

FOREIGN PATENT DOCUMENTS

KR 10-2008-0085356 9/2008
KR 10-2008-0088941 10/2008

OTHER PUBLICATIONS

International Search Report—PCT/KR2010/005989 dated May 26, 2011.

* cited by examiner

*Primary Examiner* — Alexander Gilman
(74) *Attorney, Agent, or Firm* — Cantor Colburn LLP

(57) ABSTRACT

Disclosed is a socket for a wedge bulb to maintain excellent grounding performance despite vibration encountered in use. The wedge bulb includes a light emitting element and a connector protruding from a lower end of the light emitting element and provided at each of a front surface and a rear surface thereof with a pair of parallel elastic terminals. The socket includes an elastic supporting terminal unit provided at an inner wall surface of a coupling recess defined in the socket and serving to elastically support the connector inserted into the coupling recess while achieving electrical connection with the electric terminals. Any one of each pair of the electric terminals is pressed and supported by the elastic supporting terminal unit at a different height from the neighboring electric terminal provided at the same surface of the connector and the other electric terminals provided at the opposite surface of the connector.

7 Claims, 4 Drawing Sheets

(a)

(b)

SOCKET FOR WEDGE BULB

TECHNICAL FIELD

The present invention relates to a socket to hold a wedge bulb, and more particularly, to a socket for a wedge bulb, which maintains excellent grounding performance of the wedge bulb despite vibration encountered in use.

BACKGROUND ART

A wedge bulb is a lighting device widely used in electric devices and mechanical devices including vehicles. Referring to FIG. 6, a conventional wedge bulb 4 includes a light emitting element 41 to emit light upon receiving power, and a connector 42 integrally provided at a lower end of the light emitting element 41 and configured to be inserted and fixed in an exclusive socket 200.

The connector 42 takes the form of a block and is provided at front and rear surfaces thereof with wedge shaped protrusions 421. The wedge shaped protrusions 421 serve to allow the connector 42 to be caught by a lower region of the socket 200, thereby preventing the wedge bulb 4 from being excessively inserted into the socket 200 beyond a predetermined depth. Also, a pair of electric terminals 43 is provided at the front and rear surfaces of the connector 42 to apply power to the light emitting element 41.

The socket 200 to receive the connector 42 therein is provided at an inner surface thereof with elastic terminals 210. The elastic terminals 210 are electrically conductively connectable to the respective electric terminals 43 and act to elastically press the connector 42.

More specifically, each of the elastic terminals 210 includes a terminal body 211 fixed to the socket 200, and an elastic ground piece 212 protruding from the terminal body 211.

In this case, a pair of the elastic ground pieces 212 is arranged to press a lower end of the connector 42 of the wedge bulb 4 from the front and rear sides thereof. In addition, additional press pieces 220 are used to elastically press an upper end of the connector 42 from the front and rear sides thereof. With cooperation of the elastic ground pieces 212 and the press pieces 220, the wedge bulb 4 may be fixed in the socket 200 without a risk of separation while achieving electrical connection between the electric terminals 43 and the elastic terminals 210.

However, since the above described conventional wedge bulb socket 200 holds the wedge bulb 4 by elastically pressing the lower end of the connector 42 of the wedge bulb 4, the electrical connection may become unstable due to, e.g., vibration of a mechanical device.

Specifically, the wedge bulb 4 is conventionally made of heavy glass, the light emitting element 41 protruding outward from the socket 200 has a large volume, and the connector 42 protrudes from the light emitting element 41. Therefore, the center of gravity of the wedge bulb 4 is located at the light emitting element 41, causing the wedge bulb 4 to vibrate easily relative to the socket 200 during vibration of a mechanical device, such as a vehicle, etc.

In addition, the elastic terminals 210 to elastically press the lower end of the connector 42 are arranged to press positions of the connector 42 distant from the center of gravity of the wedge bulb 4. This arrangement is disadvantageous in terms of maintenance of sufficient coupling between the wedge bulb 4 and the socket 200 during vibration of the wedge bulb 4.

The above described conventional wedge bulb socket may cause unstable connection between the electric terminals of the wedge bulb and the elastic ground pieces thereof due to vibration of the wedge bulb, thereby suffering from arcing due to defective electrical connection and burning of the electric terminals and the elastic ground pieces due to heat resulting from arcing.

DISCLOSURE OF INVENTION

Technical Problem

Therefore, the present invention has been made in view of the above problems, and it is one object of the present invention to provide a socket for a wedge bulb, which can maintain efficient grounding performance of a wedge bulb even during vibration of a mechanical device in which the socket is mounted.

It is another object of the present invention to provide a socket for a wedge bulb, which has an increased supporting area to press and fix a wedge bulb in place, thereby more securely holding the wedge bulb.

It is another object of the present invention to provide a socket for a wedge bulb, which can reduce vibration of a wedge bulb in an elastic pressing and fixing direction and a direction perpendicular to that direction.

It is a further object of the present invention to provide a socket for a wedge bulb, which has a reduced gap with a wedge bulb.

Technical Solution

In accordance with the present invention, the above and other objects can be accomplished by the provision of a socket for a wedge bulb, the wedge bulb including a light emitting element and a connector protruding from a lower end of the light emitting element and provided at each of a front surface and a rear surface thereof with a pair of elastic terminals arranged in parallel to each other, the socket including an elastic supporting terminal unit provided at an inner wall surface of a coupling recess defined in the socket and serving to elastically support the connector inserted into the coupling recess while achieving electrical connection with the electric terminals, wherein any one of each pair of the electric terminals is pressed and supported by the elastic supporting terminal unit at a different height from the neighboring electric terminal provided at the same surface of the connector and the other electric terminals provided at the opposite surface of the connector.

A first elastic supporting terminal of the elastic supporting terminal unit, which is provided to come into contact with the electric terminals provided at the front surface of the connector, may include a base plate provided at a lower end thereof with a coupler electrically conductively coupled to an electric wire that supplies power to the wedge bulb, a pair of elastic bridges vertically extending downward from opposite lateral positions of an upper end of the base plate and spaced apart from the base plate in an elastically movable manner, and elastic supporting pieces formed by bending lower ends of the respective elastic bridges to extend away from the base plate so as to come into contact with the electric terminals, positions of the elastic supporting pieces having a height difference in a vertical direction along which the connector is inserted.

The inner wall surface of the coupling recess may be provided with embossing ridges to press opposite lateral surfaces of the connector.

The coupling recess may be provided at a lower end thereof with a stepped support portion to come into surface contact with protrusions provided at the front and rear surfaces of the connector, the stepped support portion being inclined downward toward the center of the coupling recess.

Advantageous Effects

As is apparent from the above description, a socket for a wedge bulb according to an embodiment of the present invention is configured such that elastic supporting terminals of the socket, which are arranged in cis-positions, may support electric terminals of a wedge bulb respectively so as to achieve an increased wedge bulb supporting area. This has the effect of reducing vibration of the wedge bulb relative to the socket even if vibration is transmitted from an external device, thereby maintaining excellent grounding performance of the wedge bulb.

Further, according to the present invention, a coupling recess, defined in a socket housing of the socket for coupling of the wedge bulb, is provided at left and right sides thereof with embossing ridges. This has the effect of reducing left-and-right vibration of the wedge bulb, allowing the socket to more securely hold the wedge bulb therein.

Furthermore, the coupling recess of the socket is further provided at an inner circumference thereof with an inclined stepped support portion, so as to reduce a gap between inclined protrusions of a connector of the wedge bulb and the coupling recess. This has the effect of reducing the effect of vibration on the wedge bulb.

BRIEF DESCRIPTION OF DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
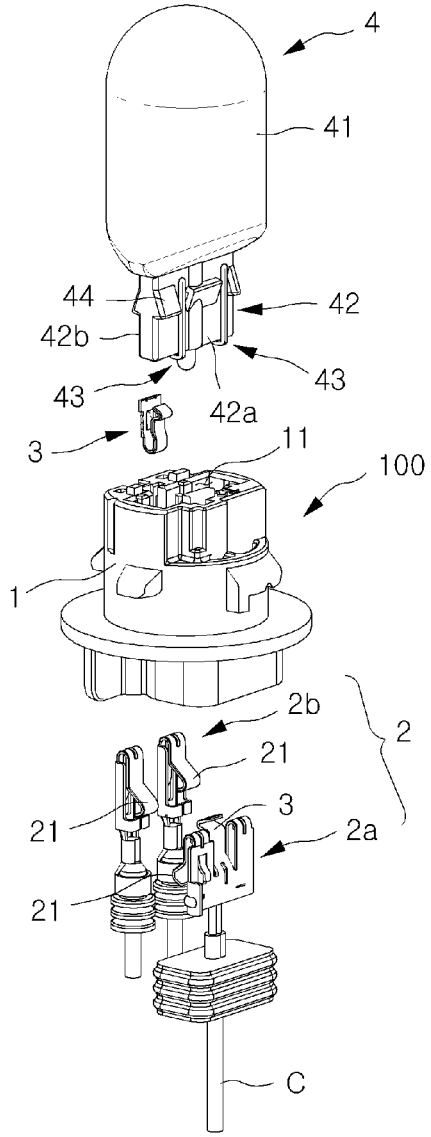
FIG. 1 is an exploded perspective view schematically illustrating a wedge bulb and a socket for the wedge bulb according to an embodiment of the present invention.

Hereinafter, functions, configurations and operations of a socket for a wedge bulb according to an exemplary embodiment of the present invention will be described in detail with reference to the accompanying drawings. In the following description, the same or like elements as those of the prior art will be designated by the same reference numerals.

FIG. 1 is an exploded perspective view schematically illustrating a wedge bulb and a socket for the wedge bulb according to an embodiment of the present invention.

The wedge bulb 4 includes a light emitting element 41 to emit light upon receiving power from an external source, and a connector 42 integrally provided at a lower end of the light emitting element 41 and configured to be inserted into a socket 100 for the wedge bulb. In this case, the connector 42 takes the form of a block having a front surface 42*a* and a rear surface 42*b* that are parallel to each other. Each of the front surface 42*a* and the rear surface 42*b* is provided with a pair of electric terminals 43 to supply power to the light emitting element 41. The electric terminals 43 vertically extend in parallel to each other. In addition, vertically inclined wedge shaped protrusions 42 are formed at opposite edge regions of each of the front surface 42*a* and the rear surface 42*b* of the connector 42.

The socket 100 includes a socket housing 1 formed of an insulator, and an elastic supporting terminal unit 2 inserted into and fixed in the socket housing 1 and electrically connected to the electric terminals 43 of the connector 42.

The socket housing 1 is molded to have an outer appearance suitable to be fitted into a mechanical device, and has a coupling recess 11 indented in an upper surface thereof, into which the connector 42 of the wedge bulb 4 is inserted.

The elastic supporting terminal unit 2 inserted in the socket 100 includes a first elastic supporting terminal 2*a* electrically connected to the electric terminals 43 provided at the front surface 42*a* of the connector 42, and a pair of second elastic supporting terminals 2*b* electrically connected to the electric terminals 43 provided at the rear surface 42*b* of the connector 42.

Figure 2:
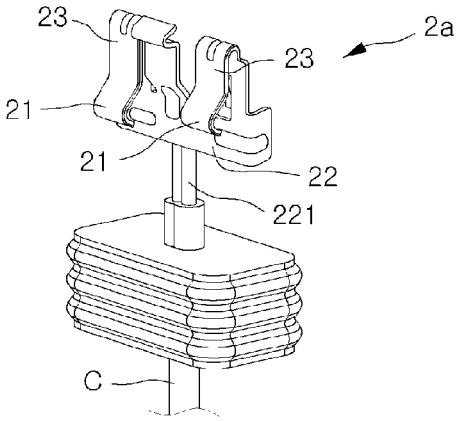
FIG. 2 is a perspective view illustrating an elastic supporting terminal unit included in the socket for the wedge bulb illustrated in FIG. 1, FIG. 2(*a*) being a perspective view of a first elastic supporting terminal, and FIG. 2(*b*) being a perspective view of second elastic supporting terminals.
Figure 2:
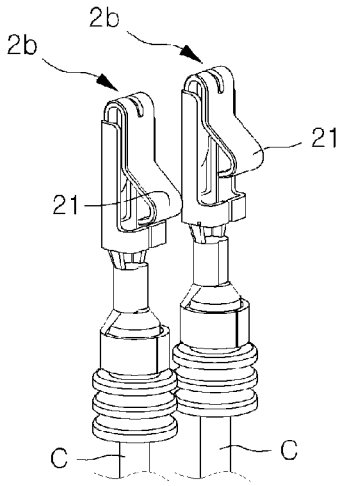

As illustrated in FIG. 2(*a*), the first elastic supporting terminal 2*a* has a single body, through which a single electric wire C is grounded in an electrically conductive manner to the pair of electric terminals 43 provided at the front surface 42*a* of the connector 42.

More specifically, the first elastic supporting terminal 2*a*, which comes into contact with the electric terminals 43 provided at the front surface 42*a* of the connector 42, includes a base plate 22, elastic bridges 23 and elastic supporting pieces 21.

The base plate 22 has an approximately rectangular shape and is inserted into the coupling recess 11 so as to be fixed to an inner wall surface of the coupling recess 11. The base plate 22 is provided at a lower end thereof with a coupler 221, which is electrically conductively coupled to the electric wire C to supply power to the wedge bulb 4.

Although not shown, the coupler 221 may include a plurality of coupling pieces, each of which is elastically deformable when connected to the electric line C, or may have other known configurations for coupling with other electric wires.

The elastic bridges 23 vertically extend downward from opposite lateral positions of an upper end of the base plate 22, and are spaced apart from the base plate 22 so as to be elastically movable toward the center of the coupling recess 11.

The elastic supporting pieces 21 are formed by bending lower ends of the respective elastic bridges 23 to extend away from the base plate 22 toward the center of the coupling recess 11 so as to come into contact with the respective electric terminals 43. In this case, the elastic supporting pieces 21 connected to the elastic bridges 23 have a height difference in a vertical direction along which the connector 42 is inserted into the coupling recess 11, thus coming into contact with the respective electric terminals 43 of the connector 42 at different heights.

Each of the pair of second elastic supporting terminals 2*b* is electrically connected to each of the elastic terminals 43 provided at the rear surface 42*b* of the connector 42, to allow the elastic terminals 43 to be electrically conductively connected to the electric wire C independently of each other.

Referring again to FIG. 1, the elastic supporting terminal unit 2 is coupled at a lower end thereof to the electric wire C that communicates with a power source of a mechanical device, and is provided at an upper end thereof with the elastic supporting pieces 21 that protrude inward of the coupling recess 11 so as to be electrically connected to the electric terminals 43 of the connector 42 while elastically pressing the front surface 42*a* and the rear surface 42*b* of the connector 42.

The coupling recess 11 is provided at an upper end thereof with press pieces 3. The press pieces 3 protrude toward the center of the coupling recess 11 to elastically press an upper end of the connector 42.

The press pieces 3 include an U-shaped elastic press piece 3 integrally formed with the first elastic supporting terminal 2*a* at a central position between both the elastic supporting pieces 21, and a press piece 3 separately inserted between an upper end of the socket 100 and the rear surface 2*b* of the connector 42 supported by the second elastic supporting terminals 2*b*. The press pieces 3 serve to elastically press upper ends of the front and rear surfaces 42*a* and 42*b* of the connector 42 without coming into contact with the electric terminals 43.

To reduce vibration of the wedge bulb 4 inserted and fixed in the wedge bulb socket 100 due to external force, such as vibration transmitted from a mechanical device, i.e. to maintain excellent grounding between the electric terminals 43 of the wedge bulb 4 and the elastic supporting pieces 21, it is necessary to increase a supporting area of the elastic supporting terminal unit 2 required to support the connector 42 of the wedge bulb 4.

To this end, each of the electric terminals 43 arranged in parallel to each other at the front and rear surfaces 42*a* and 42*b* of the connector 42 is pressed and supported by the elastic supporting terminal unit 2 at a different height from the neighboring electric terminal 43 provided at the same surface 42*a* or 42*b* of the connector 42 and the other electric terminals 43 provided at the opposite surface 42*b* or 42*a* of the connector 42.

Figure 3:
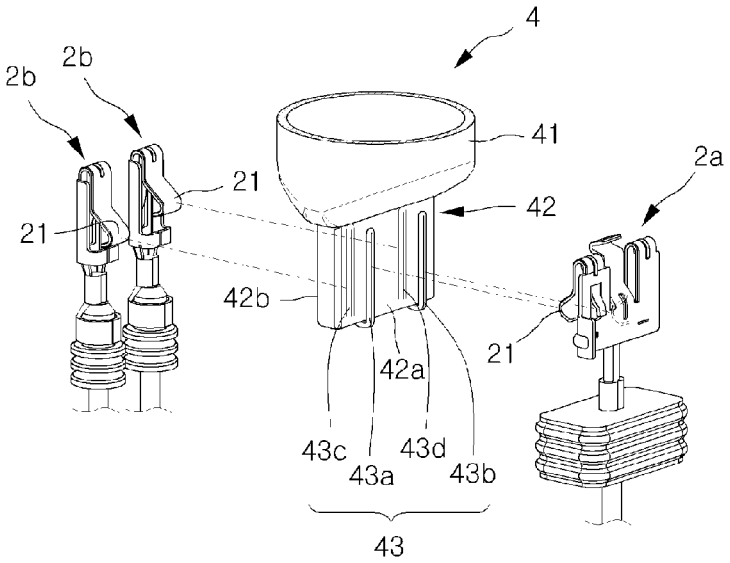
FIG. 3 is a perspective view schematically illustrating the elastic supporting terminal unit mounted in the socket for the wedge bulb illustrated in FIG. 1.

Considering the above described configuration in more detail with reference to FIG. 3, on the basis of a left one of the electric terminals 43 (hereinafter, referred to as a first electric terminal 43*a*) provided at the front surface 42*a* of the connector 42 that is electrically connected to a corresponding one of the elastic supporting pieces 21 of the first elastic supporting terminal 2*a*, the other right one of the electric terminals 43 (hereinafter, referred to as a second electric terminal 43*a*) provided at the front surface 42*a* of the connector 42 is pressed and supported by the other elastic supporting piece 21 of the first elastic supporting terminal 2*a* at a lower height than the first electric terminal 43*a*.

Also, a left one of the electric terminals 43 (hereinafter, referred to as a third electric terminal 43*c*) provided at the rear surface 42*b* of the connector 42 is supported by the corresponding second elastic supporting terminal 2*b* at a lower height than the first electric terminal 43*a*.

The other right one of the electric terminals 43 (hereinafter, referred to as a fourth electric terminal 43*d*) provided at the rear surface 42*b* of the connector 42 is pressed and supported at a higher height than the third electric terminal 43*c* provided at the same surface 42*b* of the connector 42. The fourth electric terminal 43*d* is pressed and supported at a higher height than the second electric terminal 43*b* provided at the front surface 42*a* of the connector 42.

That is, the neighboring electric terminals 43 provided respectively at the front and rear surfaces 42*a* and 42*b* of the connector 42 are supported at different heights such that the elastic supporting pieces 21 of the elastic supporting terminals 2*a* and 2*b* press and support opposite positions, i.e. cis-positions of the front and rear surfaces 42*a* and 42*b* of the connector 42.

Thereby, when the respective electric terminals 43 are electrically connected to the elastic supporting terminal unit 2 to supply power to the light emitting element 41, the elastic supporting terminal unit 2 may have an increased area to press and support the connector 42, thereby being capable of more stably supporting the wedge bulb 4 with a greater resistance to vibration transmitted from a mechanical device.

In addition, when the elastic supporting pieces 21 arranged in cis-positions press the electric terminals 43 of the wedge bulb 4, it is be possible to eliminate a moment applied to the wedge bulb 4, allowing the wedge bulb 4 to be more stably supported in the socket 100. Moreover, stable electrical connection between the electric terminals 43 and the elastic supporting pieces 21 is accomplished. This may reduce arcing due to unstable electrical connection between the electric terminals 43 and the elastic supporting pieces 21, and consequently, may prevent these electrical connection elements from burning by the arcing.

Figure 4:
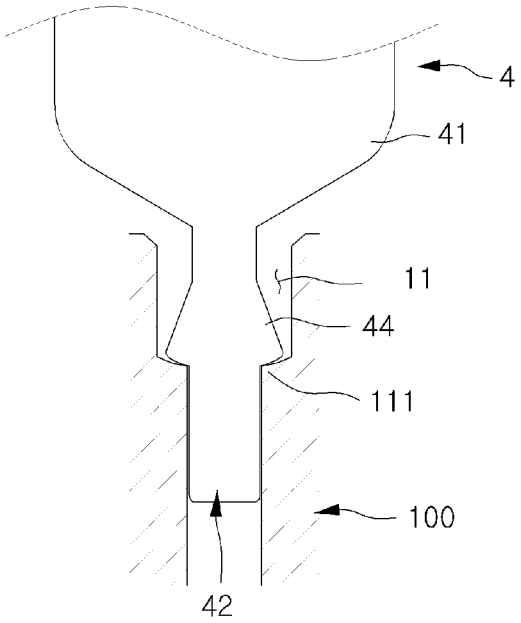
FIG. 4 is a side view schematically illustrating a coupling relationship between the wedge bulb and the socket for the wedge bulb illustrated in FIG. 1.

FIG. 4 is a side view schematically illustrating a coupling relationship between the wedge bulb and the socket for the wedge bulb illustrated in FIG. 1.

Since the wedge bulb 4 is conventionally made of glass, it is difficult to provide each corner of the wedge bulb 4 with an accurate angle and the corner of the wedge bulb 4 is rounded to within a predetermined manufacturing tolerance. On the other hand, the socket 100 is formed using synthetic resins and has a higher manufacturing tolerance than the wedge bulb 4. Thus, there exists a gap between the connector 42 of the wedge bulb 4 inserted into the socket 100 and the coupling recess 11 of the socket 100. Since the gap may cause the connector 42 of the wedge bulb 4 to be vibrated in the coupling recess 11 due to vibration transmitted from a mechanical device, it is necessary to minimize the gap, in order to prevent the wedge bulb 4 from vibrating in the coupling recess 11.

In a specific method to minimize the gap, the coupling recess 11 is provided at a lower end thereof with a stepped support portion 111 to come into surface contact with the protrusions 44 provided at the front and rear surfaces 42*a* and 42*b* of the connector 42. The stepped support portion 111 is inclined downward toward the center of the coupling recess 11.

Specifically, lower ends of the protrusions 44 formed at the wedge bulb 4 in the form of a glass molded article are inclined rather than being perfectly perpendicular to the front and rear surfaces 42*a* and 42*b* of the connector 42. Thus, the stepped support portion 111 of the coupling recess 11 to support the lower ends of the protrusions 44 must have an inclination angle corresponding to the inclined lower ends of the protrusions 44, so as to allow the protrusions 44 to come into surface contact with and be supported by the stepped support portion 11. With this configuration, it is possible to reduce a gap between the lower ends of the protrusions 44 and the stepped support portion 111, thereby allowing the wedge bulb 4 to stably come into close contact with and be supported by the coupling recess 11. This may assure stable coupling between the wedge bulb 4 and the socket 100 even upon occurrence of vibration.

Stable close contact between the protrusions 44 of the connector 42 and the stepped support portion 11 further has the effect of assuring a constant coupling depth of the wedge bulb 4. This allows the elastic supporting terminal unit 2 to press and support the electric terminals 43 at predetermined cis-positions and therefore, an assembly tolerance between the wedge bulb 4 and the wedge bulb socket 100 can be reduced. The vibration reduction effects of the present invention are equally applicable to all kinds of wedge bulbs.

Figure 5:
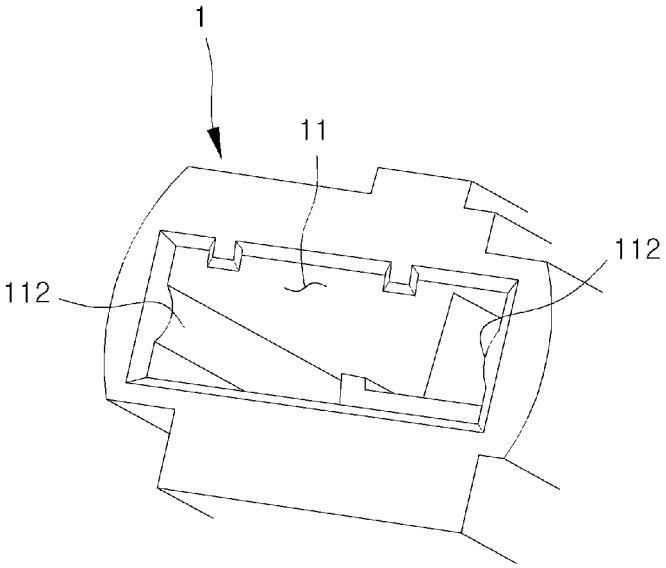
FIG. 5 is a perspective view schematically illustrating embossing ridges formed in a coupling recess of the socket for the wedge bulb illustrated in FIG. 1.
Figure 6:
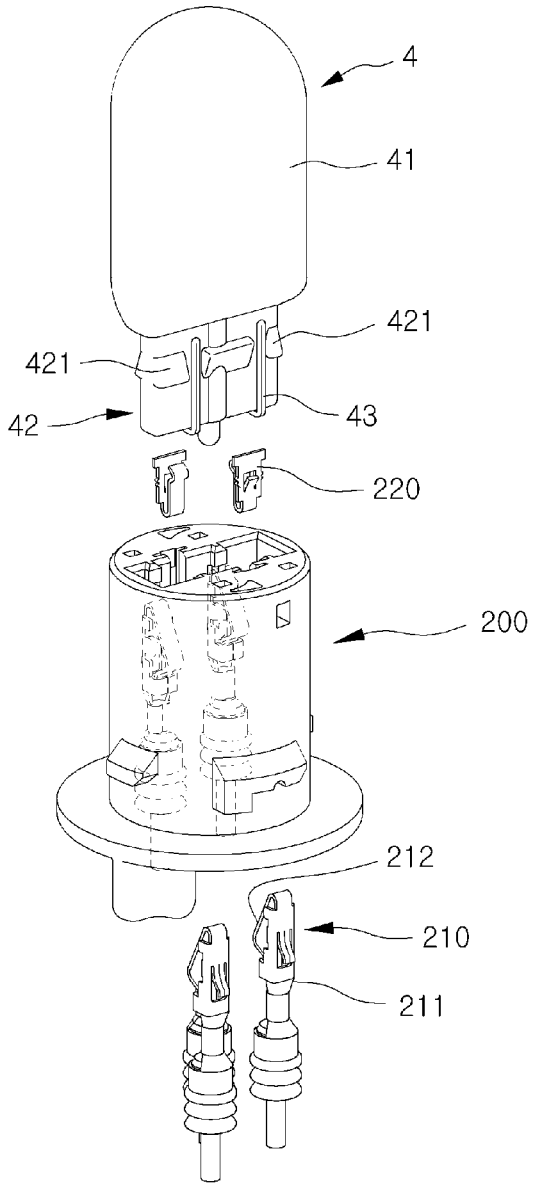
FIG. 6 is a view illustrating a conventional socket for a wedge bulb.

FIG. 5 is a perspective view schematically illustrating embossing ridges formed in the coupling recess of the socket for the wedge bulb illustrated in FIG. 1.

Vibration of the wedge bulb 4 applied through the socket 100 may be divided into front-and-rear vibration applied from the front and rear sides of the connector 42 and left-and-right vibration perpendicular to the front-and-rear vibration. The front-and-rear vibration applied from the front and rear sides of the connector 42 may be reduced by the elastic supporting terminal unit 2 that supports the connector 42 at the above described cis-positions thereof. Also, the left-and-right vibration may be reduced by the embossing ridges 112 that protrude from opposite lateral positions of the inner wall surface of the coupling recess 11 to press opposite lateral surfaces of the connector 42.

In this case, the embossing ridges 112 have an arcuate cross section and extend vertically at opposite lateral positions of the coupling recess 11. The embossing ridges 112 act to forcibly press opposite lateral surfaces of the connector 42 inserted into the coupling recess 11 from the top, enabling coupling of the socket 100 and the wedge bulb 4. In this way, it is possible to reduce left-and-right vibration of the wedge bulb 4 with respect to the socket 100 even if external vibration is applied to the socket 100 from the left and right sides.

MODE FOR THE INVENTION

Various embodiments have been described in the best mode for carrying out the invention.

INDUSTRIAL APPLICABILITY

The present invention is applicable to a socket for a wedge bulb used in electrical devices and mechanical devices including vehicles, which can reduce vibration of the wedge bulb and maintain excellent grounding performance of the wedge bulb.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A socket for a wedge bulb, the wedge bulb including a light emitting element and a connector protruding from a lower end of the light emitting element and provided at each of a front surface and a rear surface thereof with a pair of electric terminals arranged in parallel to each other, the socket comprising:

an elastic supporting terminal unit provided at an inner wall surface of a coupling recess defined in the socket and serving to elastically support the connector inserted into the coupling recess while achieving electrical connection with the electric terminals, wherein the elastic supporting terminal unit includes a first elastic supporting terminal having a pair of first elastic supporting pieces and a second elastic supporting terminal having a pair of second elastic supporting pieces, and one of the first and second elastic supporting pieces has a height difference in a longitudinal direction with respect to the other elastic supporting pieces; and wherein one of the electric terminals is pressed and supported by one of the first and second elastic supporting pieces at a different height from the other electric terminal.

2. The socket according to claim 1, wherein the first elastic supporting terminal, which is provided to come into contact with the electric terminals provided at the front surface of the connector, includes:

a base plate provided at a lower end thereof with a coupler electrically and conductively coupled to an electric wire that supplies power to the wedge bulb;

a pair of elastic bridges vertically extending downward from opposite lateral positions of an upper end of the base plate and spaced apart from the base plate in an elastically movable manner; and the first elastic supporting pieces formed by bending lower ends of the respective elastic bridges to extend away from the base plate so as to come into contact with the electric terminals.

3. The socket according to claim 1, wherein the inner wall surface of the coupling recess is provided with embossing ridges to press opposite lateral surfaces of the connector.

4. The socket according to claim 1, wherein the coupling recess is provided at a lower end thereof with a stepped support portion to come into surface contact with protrusions provided at the front and rear surfaces of the connector, the stepped support portion being inclined downward toward the center of the coupling recess.

5. A socket for a wedge bulb, the wedge bulb including a light emitting element and a connector protruding from a lower end of the light emitting element and provided at each of a front surface and a rear surface thereof with a pair of electric terminals arranged in parallel to each other, the socket comprising:

an elastic supporting terminal unit provided at an inner wall surface of a coupling recess defined in the socket and serving to elastically support the connector inserted into the coupling recess while achieving electrical connection with the electric terminals, wherein any one of each pair of the electric terminals is pressed and supported by the elastic supporting terminal unit at a different height from the neighboring electric terminal provided at the same surface of the connector and the other electric terminals provided at the opposite surface of the connector; and wherein a first elastic supporting terminal of the elastic supporting terminal unit, which is provided to come into contact with the electric terminals provided at the front surface of the connector, includes:

a base plate provided at a lower end thereof with a coupler electrically conductively coupled to an electric wire that supplies power to the wedge bulb;

a pair of elastic bridges vertically extending downward from opposite lateral positions of an upper end of the base plate and spaced apart from the base plate in an elastically movable manner; and elastic supporting pieces formed by bending lower ends of the respective elastic bridges to extend away from the base plate so as to come into contact with the electric terminals, positions of the elastic supporting pieces having a height difference in a vertical direction along which the connector is inserted.

6. The socket according to claim 5, wherein the inner wall surface of the coupling recess is provided with embossing ridges to press opposite lateral surfaces of the connector.

7. The socket according to claim 5, wherein the coupling recess is provided at a lower end thereof with a stepped support portion to come into surface contact with protrusions provided at the front and rear surfaces of the connector, the stepped support portion being inclined downward toward the center of the coupling recess.

* * * * *